United States Patent [19]

Haehnel et al.

[11] 4,154,410

[45] May 15, 1979

[54] BOBBIN WINDER

[75] Inventors: Rudolf H. Haehnel, Reading; Vincent A. Iannucci, West Lawn, both of Pa.

[73] Assignee: Rockwell International Corporation, Pittsburgh, Pa.

[21] Appl. No.: 904,017

[22] Filed: May 8, 1978

[51] Int. Cl.[2] ..... B65H 54/02; B65H 54/28; B65H 57/00; B65H 59/02

[52] U.S. Cl. ..... 242/18 R; 28/195; 242/25 R; 242/42; 242/43 R; 242/156.2; 242/157 R

[58] Field of Search ..... 242/18 R, 25 R, 35.5 R, 242/43 R, 42, 2, 3, 7.21, 7.22, 7.23, DIG. 2, 157 R, 158–158.5; 28/190, 195

[56] References Cited

U.S. PATENT DOCUMENTS

| | | | |
|---|---|---|---|
| 985,543 | 2/1911 | Pepperell | 28/195 X |
| 1,543,782 | 6/1925 | Maue | 28/195 |
| 1,867,596 | 7/1932 | Roseman | 242/DIG. 2 |
| 2,176,710 | 10/1939 | Goldsmith | 28/195 |
| 2,187,841 | 1/1940 | Pierce | 242/25 R |
| 2,250,234 | 7/1941 | Pierce | 242/25 R |
| 2,578,017 | 12/1951 | Rovas | 28/190 |
| 2,955,770 | 10/1960 | Ensor | 242/25 R |
| 3,245,624 | 4/1966 | Meyers et al. | 242/157 R X |
| 3,977,614 | 8/1976 | Hardwick | 242/2 |

*Primary Examiner*—Stanley N. Gilreath

[57] ABSTRACT

A bobbin winding machine in which a plurality of individual strands are withdrawn from separate single end supply spools and guided to a location where they are simultaneously wrapped about the outer periphery of a metering wheel. The strands leave the metering wheel in the form of a band of contiguous strands of equal length which are then caused to pass through a positioning device that is effective in maintaining equal length of the individual strands from the band. The positioning device provides a line of pivot which is common to each of the strands during swinging movement of the band by a traversing apparatus spaced from the positioning device which includes elements mounted thereon for guiding and presenting the band to a rotatably driven bobbin for the purpose of building a band package thereon.

7 Claims, 27 Drawing Figures

BOBBIN WINDER

BACKGROUND OF THE INVENTION

The invention pertains to a bobbin winding machine and more particularly to a machine for simultaneously withdrawing a plurality of strands from individual single end supply spools and assembling them in side by side relationship for winding as a band on a rotatably driven bobbin.

U.S. Pat. No. 2,955,770 shows and describes one form of machine for rewinding strand material from a plurality of single end supply spools onto a bobbin in the form of a band of contiguous ends.

For the purpose of brevity the term "strands" will hereinafter be referred to as "ends".

As is well known to those conversant in the art of fabricating hose requiring armored covering, such as hydraulic hose, a preliminary manufacturing step is that of rewinding wire from a plurality of large single-end supply spools to form smaller multi-ended bobbins.

During this preliminary manufacturing step of rewinding the wire, it is considered extremely important that each of the plurality of ends be of equal length when forming the so-called band and that their length be maintained the same while being wound as a band onto a bobbin. Unequal length of ends forming a band will very likely result in a rejected or finished product not possessing or meeting the specific requirements of the armored covering necessary for the intended use of a covered hose. Ends within a band which are longer than adjacent ones can cause cross-overs, looping or simply being under less tension than adjacent ends, it is obvious these ends would fail to serve their intended purpose.

On the other hand ends which are shorter than adjacent ends within a band can be equally troublesome for the stretching of an end during the rewinding or braiding operation can cause breakage thereof or weaken it to the point of subsequent breakage during the performance of its intended function.

The winding apparatus of the present invention provides a means for presenting a plurality of ends drawn from single-end supply spools to a metering member to form a band of contiguous ends of equal length and a further means for maintaining equal length of said ends during presentation of the band to a traversing device which includes elements for effecting winding of the band on a rotatably driven bobbin.

SUMMARY OF THE INVENTION

The bobbin winder according to the invention supports a plurality of single-end supply spools each of which is provided with a let-off braking device that controls the tension under which the ends are withdrawn. The ends are separately guided to a location where they are simultaneously wrapped about the outer periphery of a metering wheel which is effective in positioning the ends in contiguous relation to form a band of ends which are of equal length. When the band leaves the metering wheel it is received by a positioning device that is operatively associated with a traversing apparatus. The positioning device provides a means for maintaining equal length of each of the ends forming the band by changing the attitude of the band from a pathway which was parallel with the axis of the metering wheel as it left the latter to one extending normal thereto. The elements of the positioning device are disposed in spaced relation with the band receiving portion being located adjacent to the metering wheel and with the opposite or delivery portion being mounted on and for movement with the traversing apparatus.

This arrangement of the positioning device provides a line of pivot for the band at the receiving portion thereof which is common to each of the ends forming said band during movement of the delivery portion with the traversing apparatus. In alignment with the delivery portion of the positioning device and in close proximity therewith the traversing apparatus is provided with elements which are effective in turning the band to extend in a plane normal to that effected by said positioning device and for presenting the band to a rotatably driven bobbin for the building of a band package thereon.

It is a general object of the invention to provide an improved winder for winding a plurality of separate ends, drawn from independent sources, as a band on a bobbin.

Another object is that of providing an improved winder having means for assuring the ends forming a band are maintained at equal length when wound onto a bobbin.

A further object is that of providing an improved winder which will perform its intended function at higher speed than known types of winders of the prior art.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
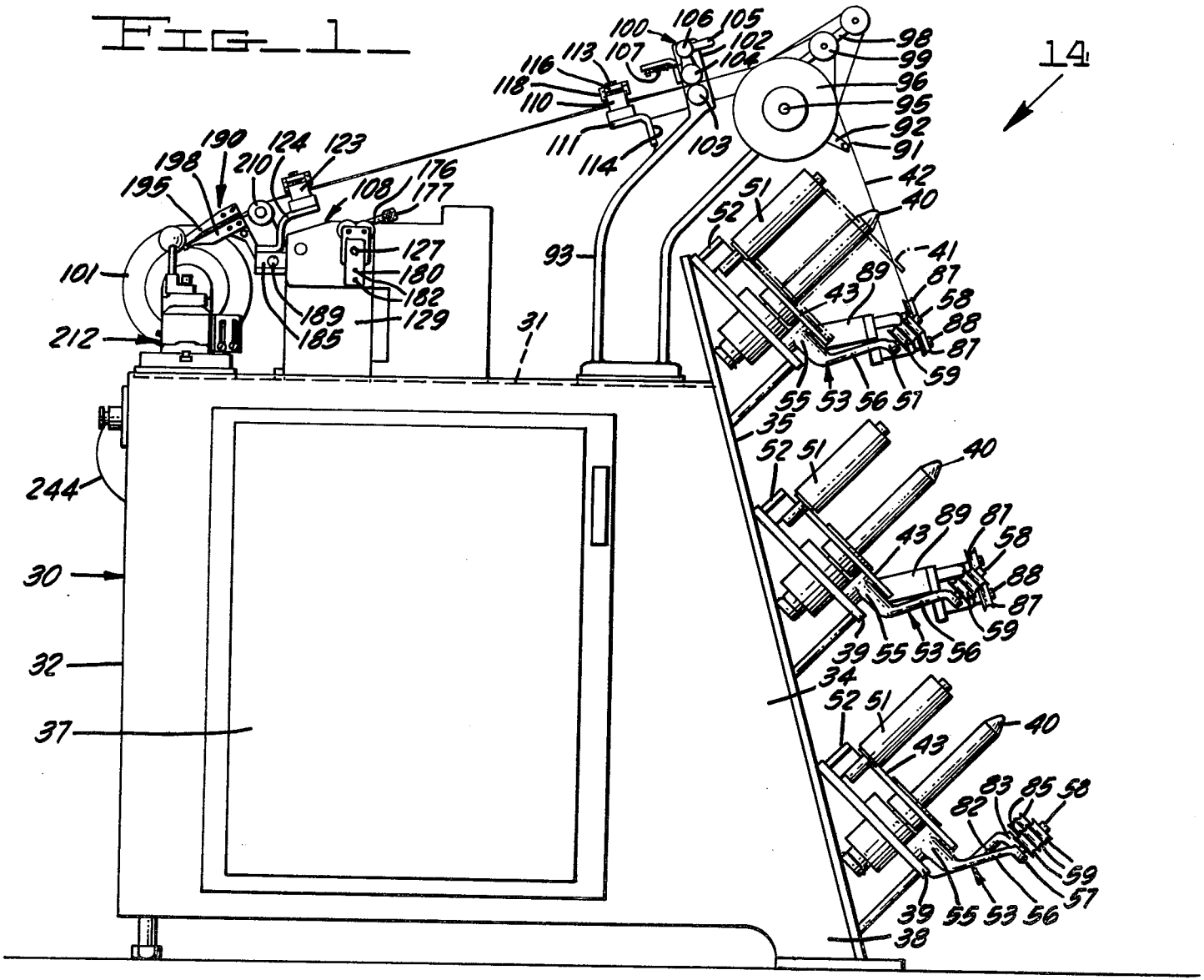
FIG. 1 is a view in side elevation of the bobbin winder according to the invention.
Figure 2:
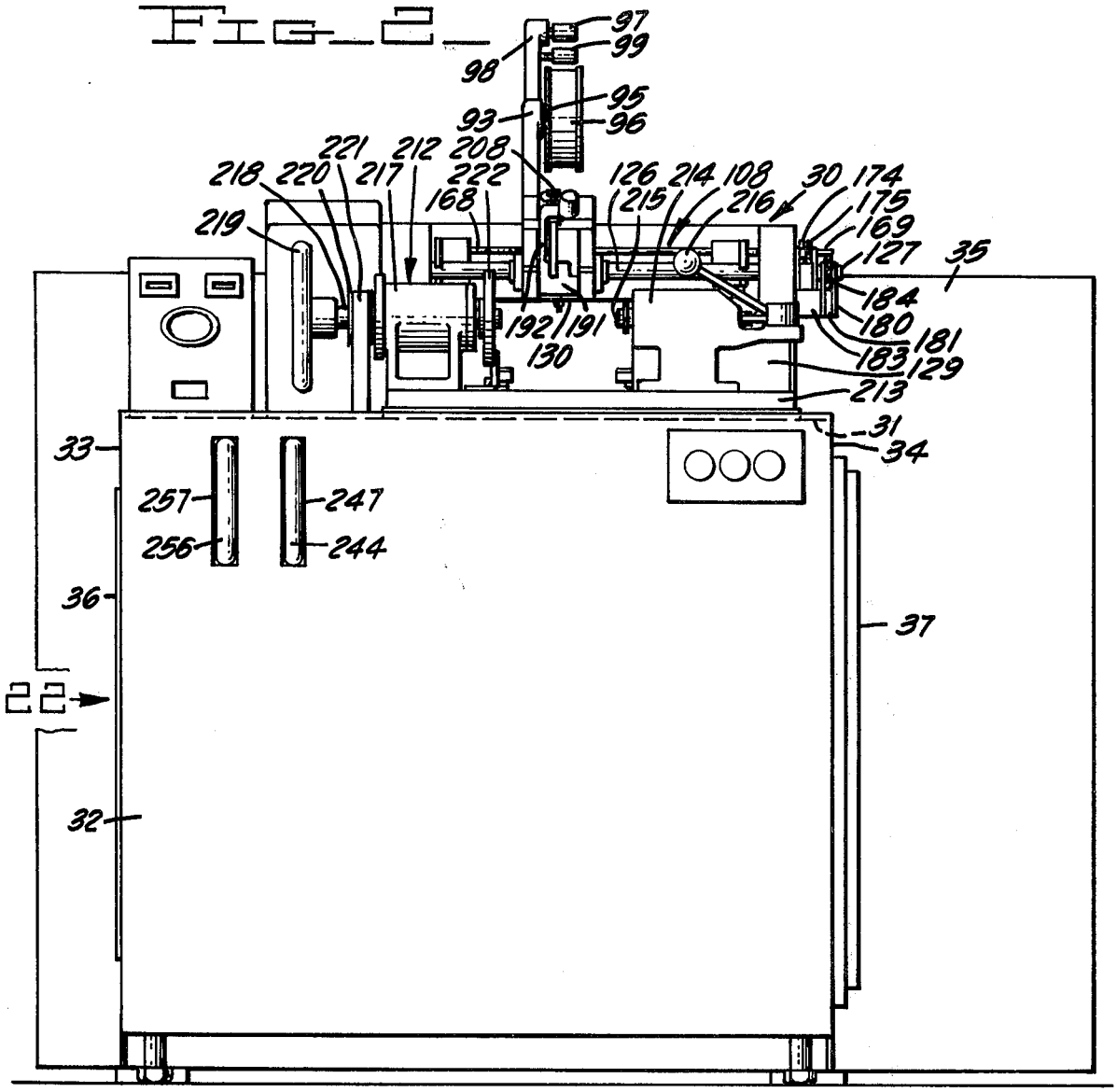
FIG. 2 is a view in front elevation of the winder in FIG. 1.

Referring now to the figures of drawing, the bobbin winder according to the invention is identified generally in FIGS. 1 and 2 by numeral 30. The winder includes a supporting frame of box-like structure having a top planar surface 31, a front vertical panel 32, left and right hand side panels 33 and 34 respectively and a rear wall which defines a supply spool rack 35. The left hand side panel 33 is provided with a removable access panel 36 and the right hand side panel includes a hinged access door 37 both of which provide a means for gaining access to the various devices for effecting operation of the winder and which will be more fully described hereinafter. The upper end of the supply spool rack 35 as shown in FIG. 1 is located above the top planar surface 31 and extends angularly downward to the rear base portion of the supporting frame which is identified by numeral 38. This supply spool rack 35 has a plurality of support brackets 39 fixed thereon and each bracket is provided with a rotatably mounted spindle 40 which is adapted to support a single end supply spool 41.

Each of the support brackets 39 has a let-off braking device which is effective in controlling the tension of ends 42 as they are withdrawn from their respective supply spools 41. Each of the let-off braking devices have an identical combination of parts which all function in a like manner. This device is best seen in FIGS. 4 and 14–17 and includes a brake disc 43 assembled for rotation with and adjacent the lower end of the spindle 40. The spindle is centrally located relative to the brake disc with the axle thereof extending in a direction normal to the upper surface of the disc which serves to engage one end of a supply spool 41 when the latter is impaled on said spindle.

The let-off braking device is mounted on the support bracket 39 and includes a brake puck 44 disposed for engagement with the underside of the brake disc 43. The brake puck 44 is carried by a support member 45 and includes a pair of depending pins 46 and 47 (FIG. 17) the lower ends of which are disposed in operative association with a pivotably mounted V-block type cam 48. This cam 48 has one end of a brake lever 49 fixed to the underside thereof by means of screws 50 (FIG. 16) and by pivoting the lever in one direction or the other, by a means yet to be described, the braking force of the puck will be increased or decreased as required to maintain a desired amount of tension on the end 42 being withdrawn from its supply spool 41.

The end 42 as it is withdrawn from a supply spool is caused to engage an elongated guide roller 51 which is rotatably supported in a T-shaped block 52 mounted on the support bracket 39 in spaced relation to the spindle 40 and in a manner whereby the axis thereof extends in a direction parallel with that of said spindle.

Figures 4, 5:
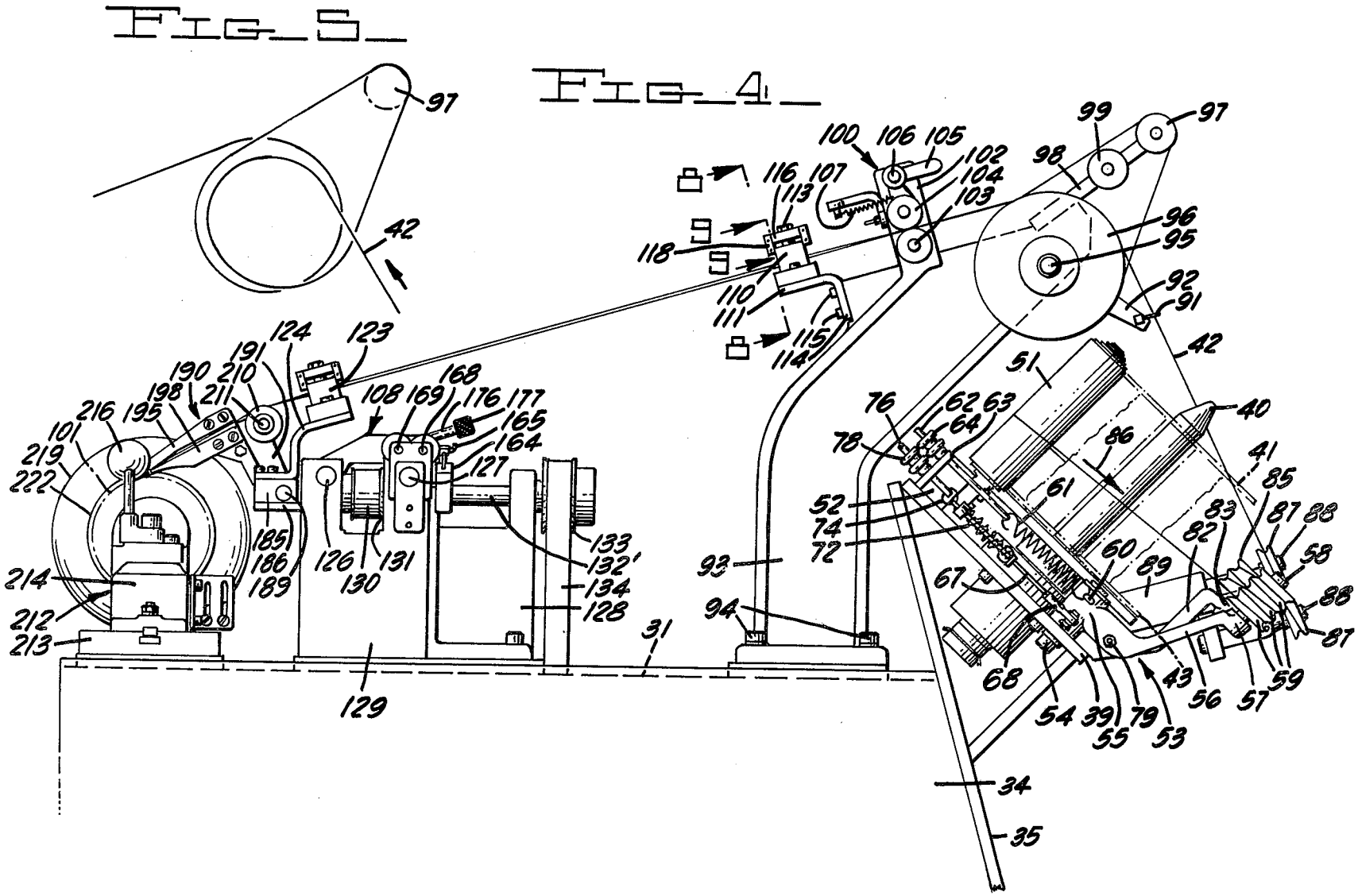
FIG. 4 is a view on an enlarged scale of the upper portion of FIG. 1.
FIG. 5 is a schematic view showing the manner in which an end engages the metering wheel.

A dancer lever generally indicated by numeral 53 (FIGS. 4 and 14) is pivotably mounted on the support bracket 39 by means of a bolt 54 extending through a hub portion 55 of said dancer lever. As best seen in FIGS. 1 and 4 this dancer lever includes an arm 56 extending from the hub portion 55 which terminates in a hub 57 within which one end of a stud 58 is fixedly assembled. This stud 58 has three sheaves 59 rotatably mounted thereon which serve to receive and guide an end 42 extending from the elongated guide roller 51 in a manner to be more fully described hereinafter.

The hub portion 55 of the dancer lever 53 includes an integrally formed lug 60 (FIGS. 4, 14 and 15) to which one end of a coil spring 61 attaches. The opposite end of this coil spring 61 is attached to the end of a threaded rod 62 that is supported in a first arm 63 of the T-shaped block 52 and is longitudinally adjustable therein by means of an adjustment nut 64. The longitudinal adjustment of the threaded rod 62 serves to increase or decrease the tension of the coil spring 61 as desired which is effective in continually urging the dancer lever in the direction of the indicating arrow 65 shown in FIG. 14. Below and in alignment with lug 60, the hub portion 55 of the dancer lever 53 also includes an integrally formed arm 66 (FIG. 14), extending therefrom from having a brake rod 67 pivotably attached to its outer end by means of a rod-end bearing 68. The brake rod 67 extends through an opening 69 (FIG. 16) provided in that end of the brake lever 49 most remote from the cam 48 and adjacent that end opposite the end having the rod end bearing 68 said brake rod has a collar 70 assembled thereon (FIG. 14) which is selectively positionable by means of a set screw 71. Intermediate the collar 70 and the brake lever 49 a brake release spring 72 is assembled on the brake rod 67 under a selected amount of tension. This spring 72 is effective, upon an increase in tension of an end 42 being withdrawn from the supply spool 41, in pivoting the brake lever 49 in a counter-clockwise direction as viewed in FIG. 14 which in turn reduces the braking force of the brake puck 44 on the brake disc 43. The brake lever 49 is continually urged in the direction of the indicating arrow 73 (FIG. 14) by means of a coil spring 74 which has one end attached to said brake lever as at 75. The opposite end of coil spring 74 is attached to a threaded rod 76 that is supported in a second arm 77 of the T-shaped block 52. This threaded rod 76 is longitudinally adjustable by means of an adjustment nut 78 which enables pre-loading of the coil spring 74 under the required amount of tension for returning the brake lever 49 to its initial position after movement thereof by the brake release spring 72.

Figure 14:
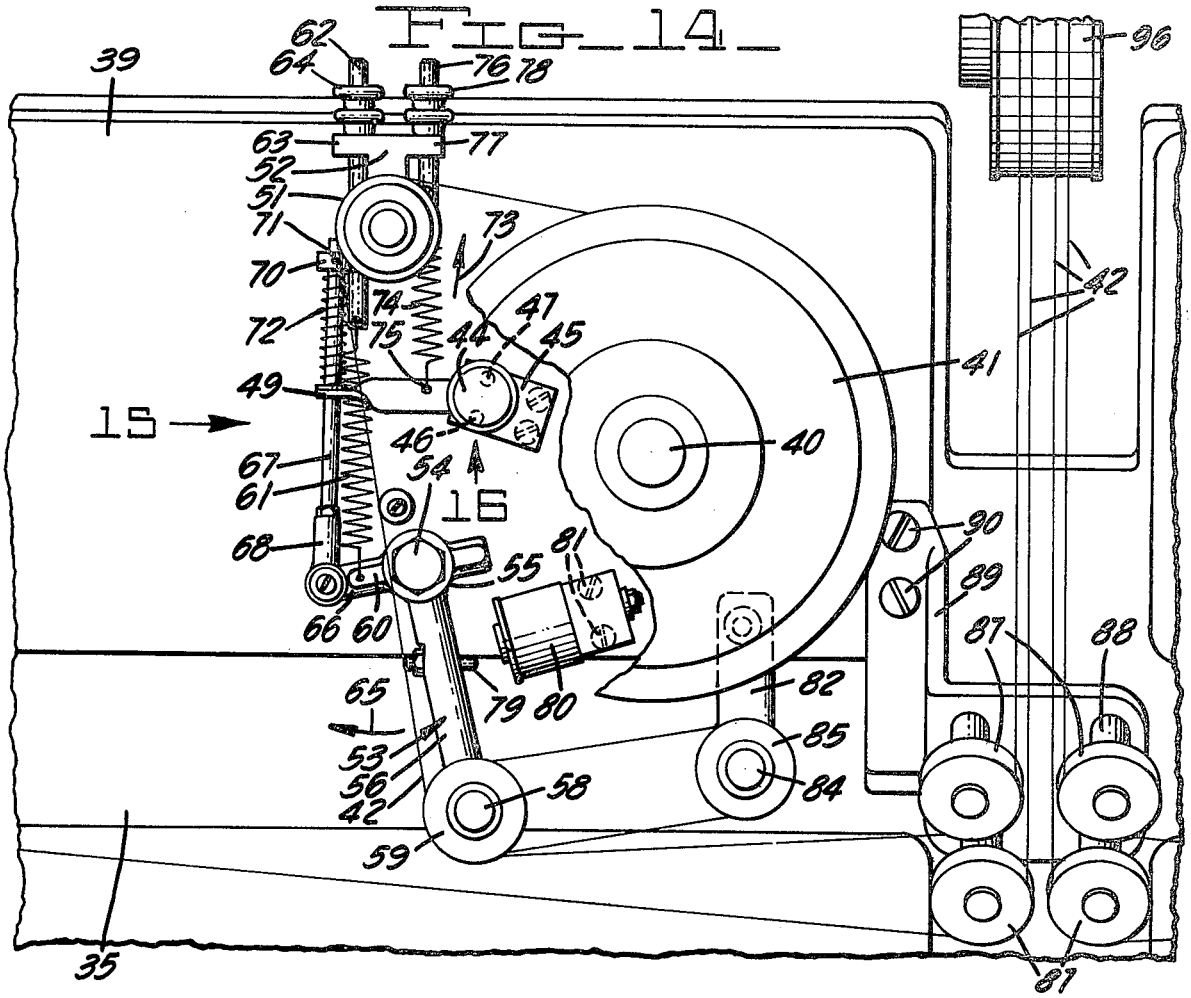
FIG. 14 is a view looking in the direction of the indicating arrow 14 in FIG. 1.
Figure 15:
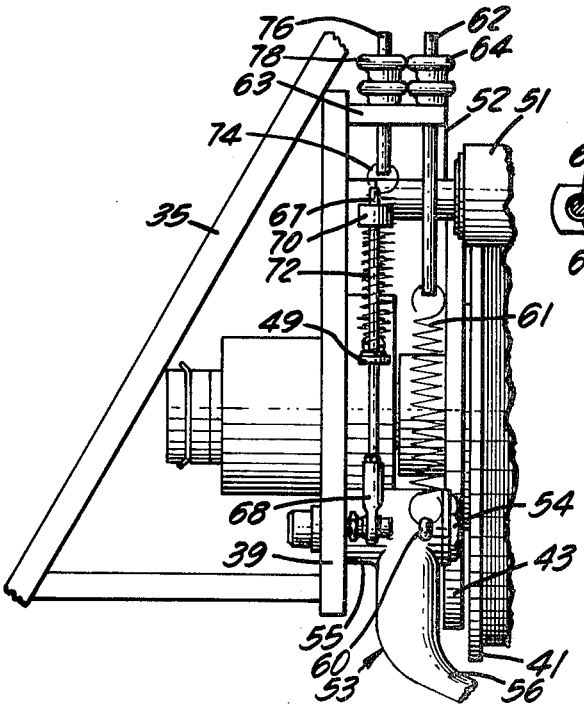
FIG. 15 is a view looking in the direction of the indicating arrow 15 in FIG. 14.
Figure 16:
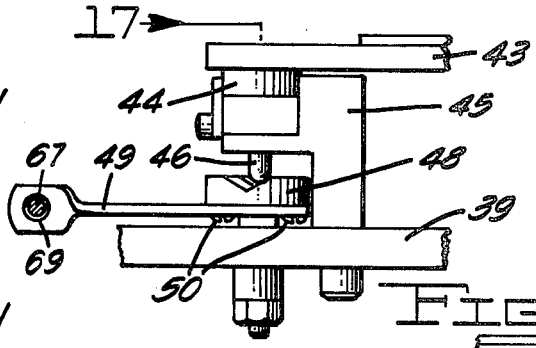
FIG. 16 is a view looking in the direction of the indicating arrow 16 in FIG. 14.
Figure 17:
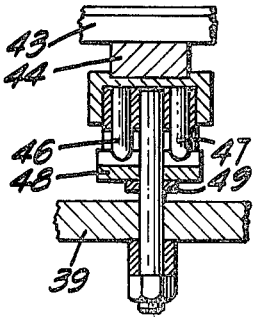
FIG. 17 is a sectional view as seen looking in the direction of the indicating arrows of line 17—17 in FIG. 16.

Pivotal movement of the dancer lever 53 in a counter-clockwise direction, as viewed in FIG. 14 and resulting from an increase in tension of an end 42 is limited by means of a stop screw 79 mounted in the arm 56 of said dancer lever which is adapted to engage a stop member 80. This stop member 80 is attached to the support bracket 39 by means of screws 81.

Referring now to FIGS. 1, 4 and 14, a support arm 82 is fixed on the support bracket 39 in spaced relation to the dancer lever 53 and extending from its location of attachment to said support bracket its outer end terminates in the form of a hub 83. This hub 83 has one end of a stud 84 fixed therein and with the remainder of said stud extending in a direction parallel with the axis of stud 58 assembled in the hub 57 of the dancer lever 53. A pair of sheaves 85 are rotatably mounted on the stud 84 and serve to cooperate with sheaves 59 for guiding an end 42 being withdrawn from the supply spool 41 in a manner now to be described. As shown in FIG. 4, the end 42 as it is withdrawn from the supply spool 41 engages the outer surface of the elongated guide roller 51 and then follows a pathway which causes it to first engage the lower of the three sheaves 59 and thence the lower of the two sheaves 85. From the lower sheave 85 the pathway is reversed so that the end 42 engages the intermediate sheave 59 from which it extends to the upper sheave 85 and then back to the upper sheave 59. The end 42 is caused to travel in the direction of the indicating arrow 86 shown in FIG. 4, and from the upper sheave 59 it extends to one of a plurality of guide sheaves 87. These guide sheaves 87 are rotatably mounted on separate pins 88 which are supported on a bracket 89 that is attached to the support bracket 39 by means of screws 90. Bracket 89 is located in a generally central location relative to the supply spool rack 35.

The bobbin winder disclosed herein is provided with three horizontal rows of supply spools 41 with four spools in each row along with a centrally located bracket 89 in each row with separate guide sheaves 87 mounted thereon for separately and independently guiding an end 42 from its particular source. The plurality of ends extend from their guide sheaves 87 in a generally upwardly direction (FIGS. 1 and 4) and are caused to pass through separate dents of a guide comb 91. This guide comb 91 is assembled on a support arm 92 that is attached by any suitable means to an arcuated support stand 93 which is fixedly mounted on the top planar surface 31 by means of bolts 94. The arcuated support stand is provided adjacent its upper end with a laterally extending stud member 95 on which a metering wheel 96 is rotatably assembled. The metering wheel 96 serves as a means for receiving all of the ends 42 simultaneously and joining them in a band of contiguous ends of equal length. Each end 42 is individually wrapped about the outer periphery of the metering wheel 96 and after the first wrap it travels to one of a group of guide rollers 97 that are rotatably carried on an arm 98 fixed on the upper end of the arcuated support stand 93. To provide a separate guide roller for all of the ends which are received by the metering wheel, arm 98 also rotatably supports an additional group of guide rollers 99 which serve the same function as guide rollers 97 by providing a means for distributing the total number of ends between both groups of said rollers. These guide rollers are disposed so as to cause the ends guided thereby to re-engage the metering wheel in a slightly different pathway and after making another wrap about said wheel, they are effective as the ends leave the wheel in forming a band of contiguous ends with each individual end being of a length equal to the adjacent ends which together form said band.

When the band leaves the metering wheel 96, it is caused to pass through a selective clamping device, generally indicated by numeral 100, and serves as a means for holding a band of ends, which has been cut, for the purpose of replenishing a bobbin 101 on which a band package is adapted to be formed.

The selective clamping device 100 as shown in FIGS. 1 and 4 includes a support block 102 which forms an integral part of the upper end portion of the arcuated support stand 93. The support block includes an eccentrically positionable first roller 103 and a second roller 104 on one arm of a bell crank lever 105 which is pivotably mounted on said block as at 106. In operation the rollers 103 and 104 have sufficient clearance therebetween so as to permit the band to advance without interference. To clamp the band of ends one simply pivots roller 104 in a counter-clockwise direction by means of the bell crank lever 105 and against the biasing force of a coil spring 107.

To maintain equal length of each of the ends 42 forming the band, each individual end must be caused to follow a pathway identical to the other ends forming the band. This is accomplished by turning the band 90° at two-spaced locations along its pathway with one of the locations being mounted on a traversing mechanism generally identified by numeral 108 and which will be more fully described hereinafter.

Figure 8:
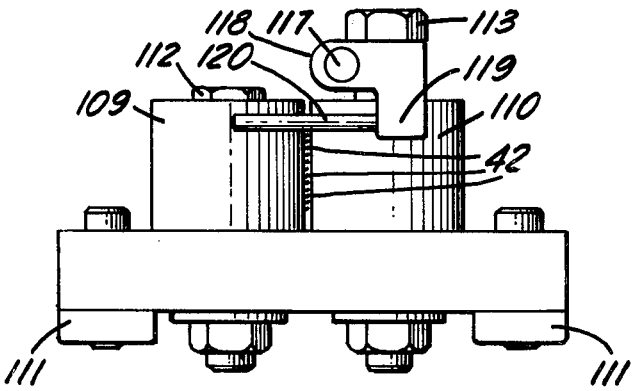
FIG. 8 is a view as seen looking in the direction of the indicating arrows of line 8—8 in FIG. 4.
Figure 9:
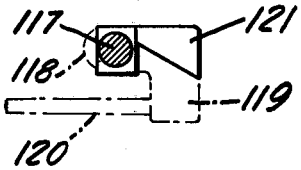
FIG. 9 is a view on an enlarged scale as seen looking in the direction of the indicating arrows of line 9—9 in FIG. 4.
Figure 10:
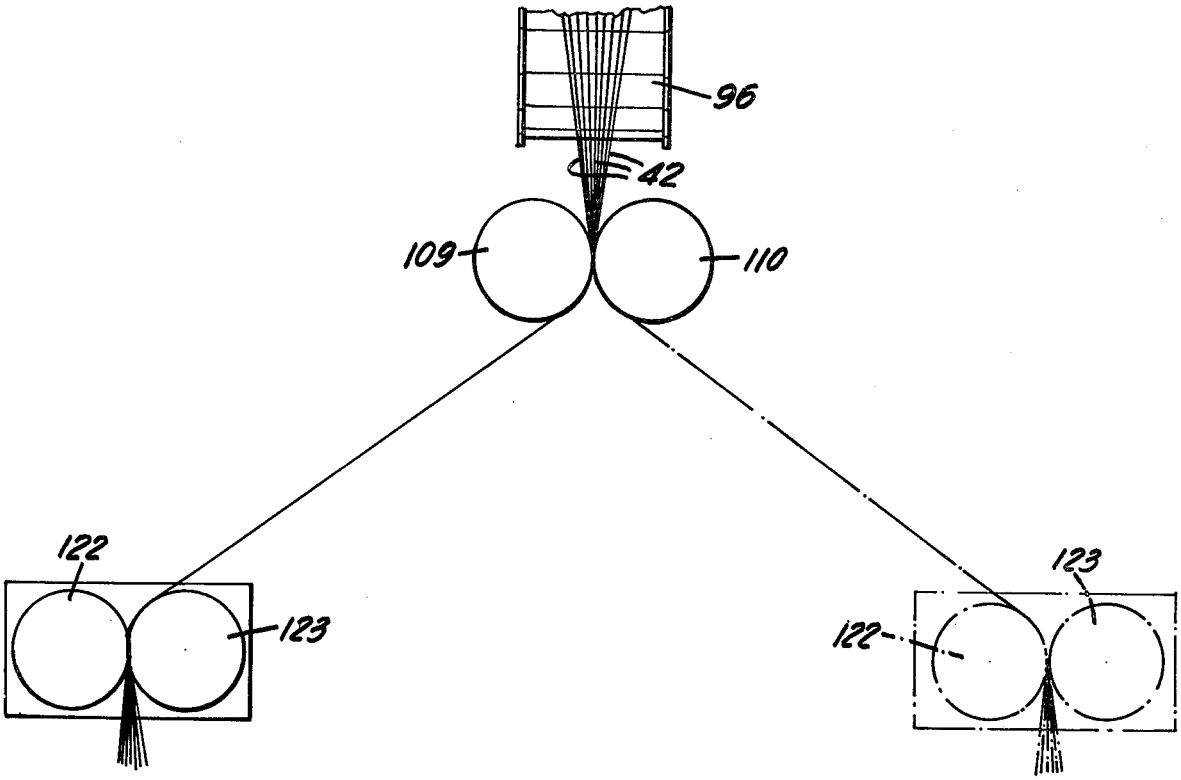
FIG. 10 is a schematic view showing the pathway of a band after leaving the metering wheel.

The means for turning the band so that it will travel in a plane turned 90° from the plane of travel at which it left the metering wheel 96 includes a pair of juxtapositioned rollers 109 and 110 rotatably mounted on a support member 111 by means of bolts 112 and 113 respectively. This support member 111 is fixedly attached to the upper portion of the arcuated support stand 93 as at 114 by cap screws 115 (FIG. 4). The rollers 109 and 110 being disposed in side by side relation with the axes thereof extending in a plane normal to the axis of the metering wheel 96, are spaced one from the other a distance which provides clearance for the band as it is caused to be advanced therebetween. As shown in FIGS. 4 and 8 a means is provided for preventing upward movement of the band while passing between rollers 109 and 110 which includes a band guard block 116 assembled on bolt 113 in a location intermediate the head of the latter and said roller 110. Block 116 extends in the direction of travel of the band and is of a length equal to the diameter of the rollers 109 and 110. A pivot pin 117 (FIGS. 8 and 9) extends through the block 116 and each end thereof has a support arm 118 fixed thereon for selective pivotal movement with said pin. This support arm 118 includes a depending extension 119 within which one end of a roll pin 120 is fixed and extending from said extension the pin overlies the pathway of the band as the latter enters and exits from between the rollers 109 and 110. The support arm 118 is provided with an integrally formed stop member 121 which is adapted to engage the front of block 116 when the roll pin is in its operating position shown in FIG. 8. The remainder of the support arm 118 is of a thickness whereby it and the roll pin 120 carried thereby can be pivoted upwardly when desired.

Figure 18:
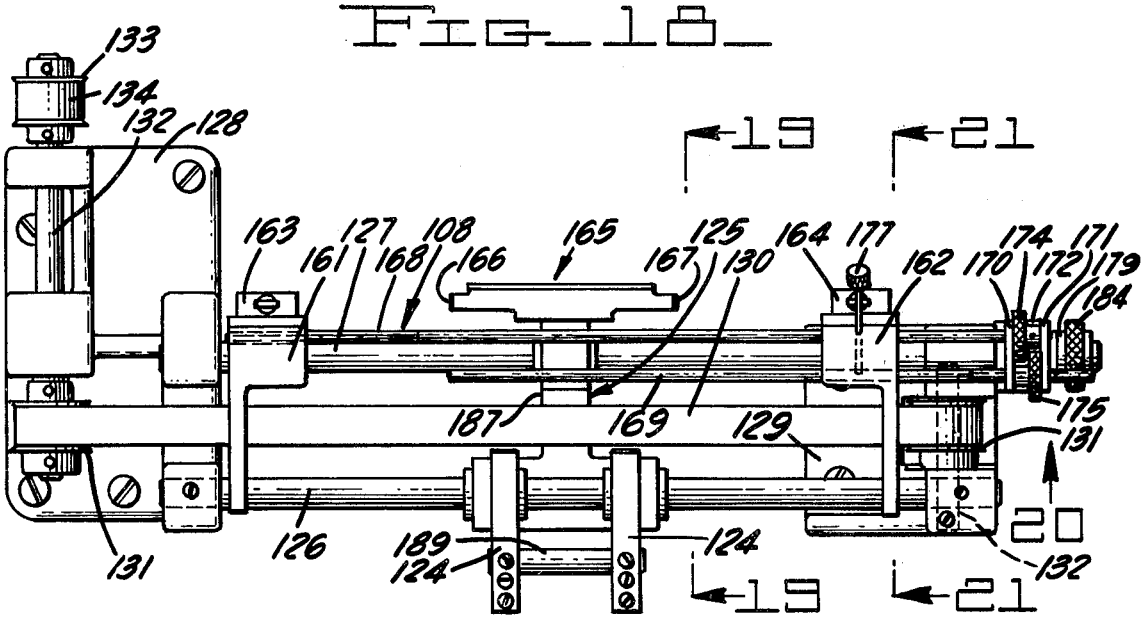
FIG. 18 is a top view of the traversing apparatus as seen looking in the direction of the indicating arrows of line 18—18 in FIG. 3.
Figure 22:
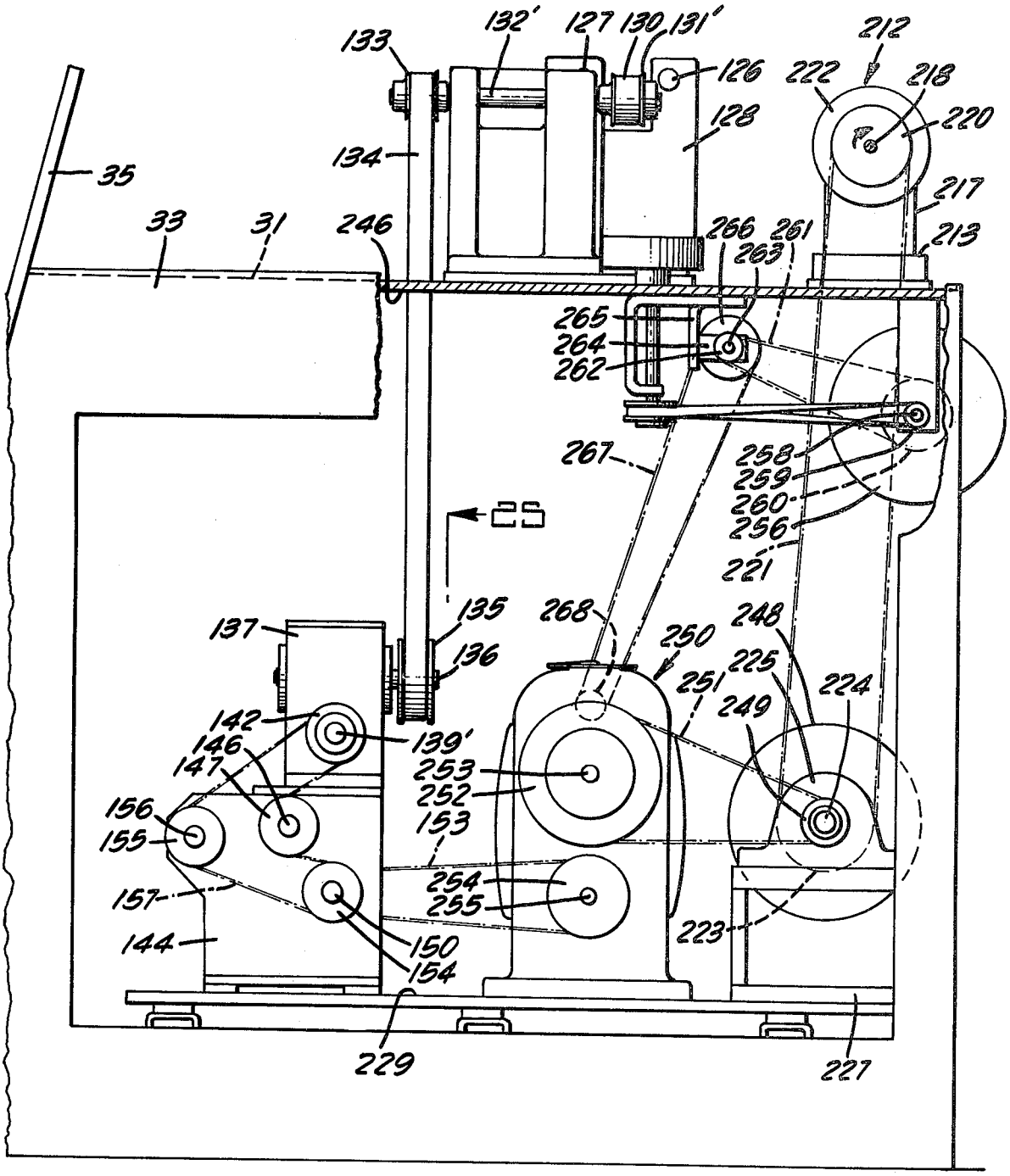
FIG. 22 is a view in side elevation looking in the direction of the indicating arrow 22 in FIG. 2 showing the various driving elements of the winder.
Figures 23, 24:
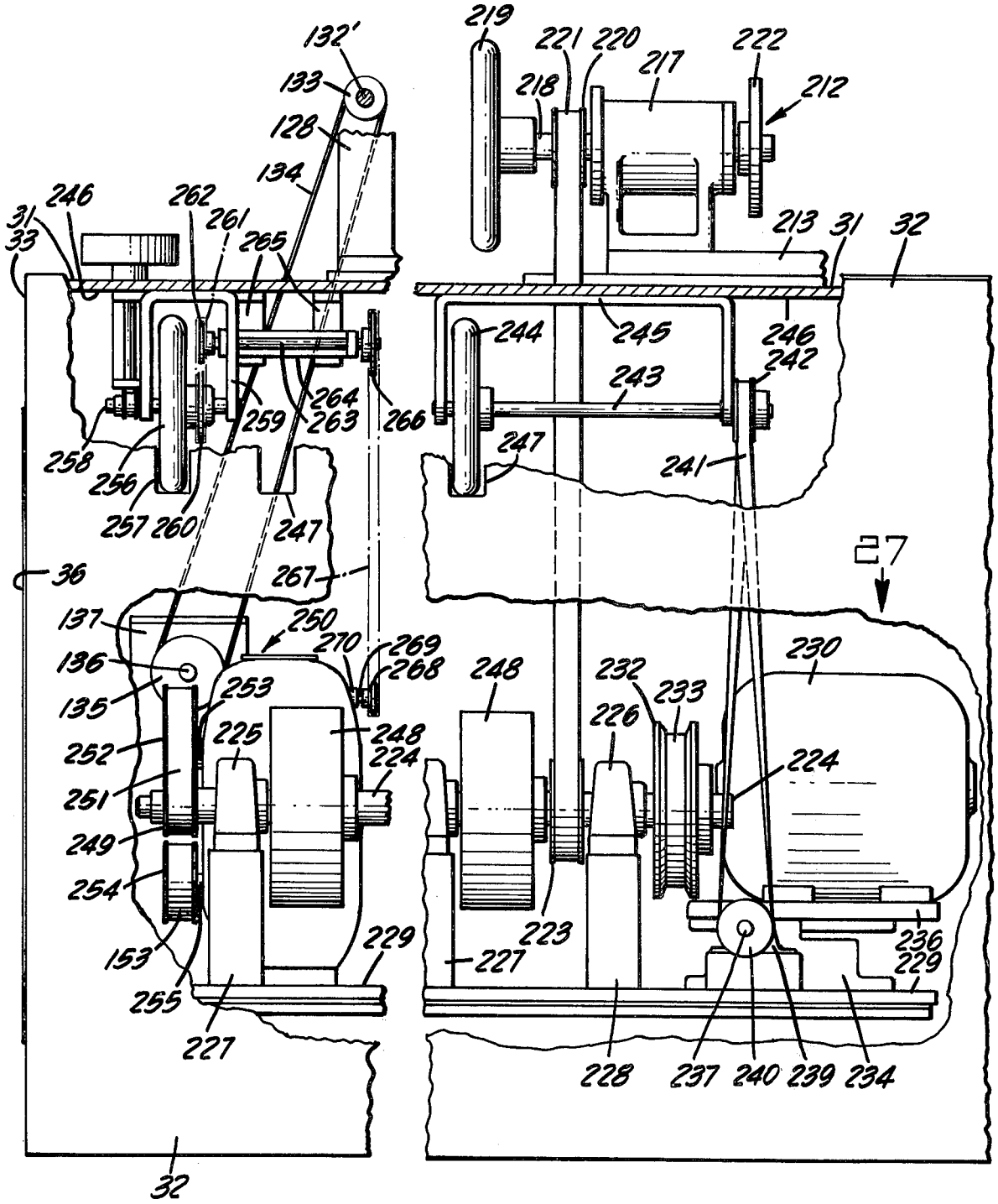
FIG. 23 is a partial front elevational view with portions broken away to show the means for driving and controlling the traversing apparatus.
FIG. 24 is a partial front elevational view with portions broken away to show the means for rotating a bobbin.
Figure 26:
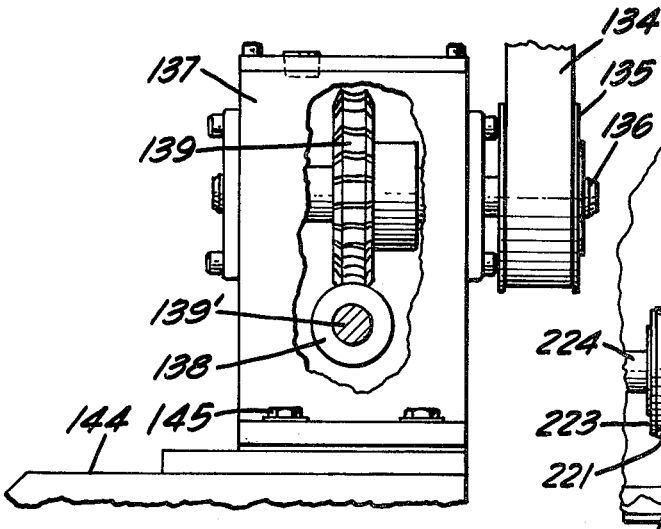
FIG. 26 is an elevational view as seen looking in the direction of the indicating arrow 26 in FIG. 25 with a portion broken away to show the gearing for effecting actuation of the transversing apparatus.

The band after leaving the rollers 109 and 110 is maintained in the pathway changed by said rollers by being caused to pass between a pair of identical rollers 122 and 123. Rollers 122 and 123 are mounted, include the same elements as, and function in the same manner as rollers 109 and 110 except they are supported by a pair of bracket members 124 which are mounted on a carriage 125 of the traversing mechanism 108 and are caused to move to and fro with said carriage. The carriage 125 is mounted for reciprocating movement on a pair of spaced traverse rods 126 and 127 which are disposed in parallel relation. The ends of the traverse rods 126 and 127 are supported at one end in a stand member 128 and at their opposite ends in a stand member 129 (FIG. 18). A timing belt 130 traverses the distance between the stand members 128 and 129 and as shown in FIG. 18 said belt is operatively connected to a pulley 131 which is rotatably mounted on a rod 132 that is assembled within the stand member 129. The timing belt 130 is of the endless type and is reciprocally driven, in a manner yet to be described, by a pulley 131' that is mounted on one end of a driven shaft 132'. This driven shaft is rotatably supported in the stand member 128 and that end opposite the end on which pulley 131' is mounted extends outwardly beyond said stand member and has a driven pulley 133 fixed thereon. A drive belt 134 as shown in FIGS. 22 and 23 interconnects the driven pulley 133 with a drive pulley 135 that is assembled on a shaft 136. This shaft 136 is mounted in and extends from a gear box 137 which houses a worm 138 and worm wheel 139 (FIG. 26) for effecting oscillating movement of the shaft 136. The worm wheel is mounted on shaft 136 within the gear box 137 and is disposed in meshing relation with the worm 138 that is assembled on a shaft 139' which extends outwardly from each side of the gear box 137 and is oriented so that the axis thereof is disposed below and extends in a plane normal to the axis of said shaft 136.

Figure 25:
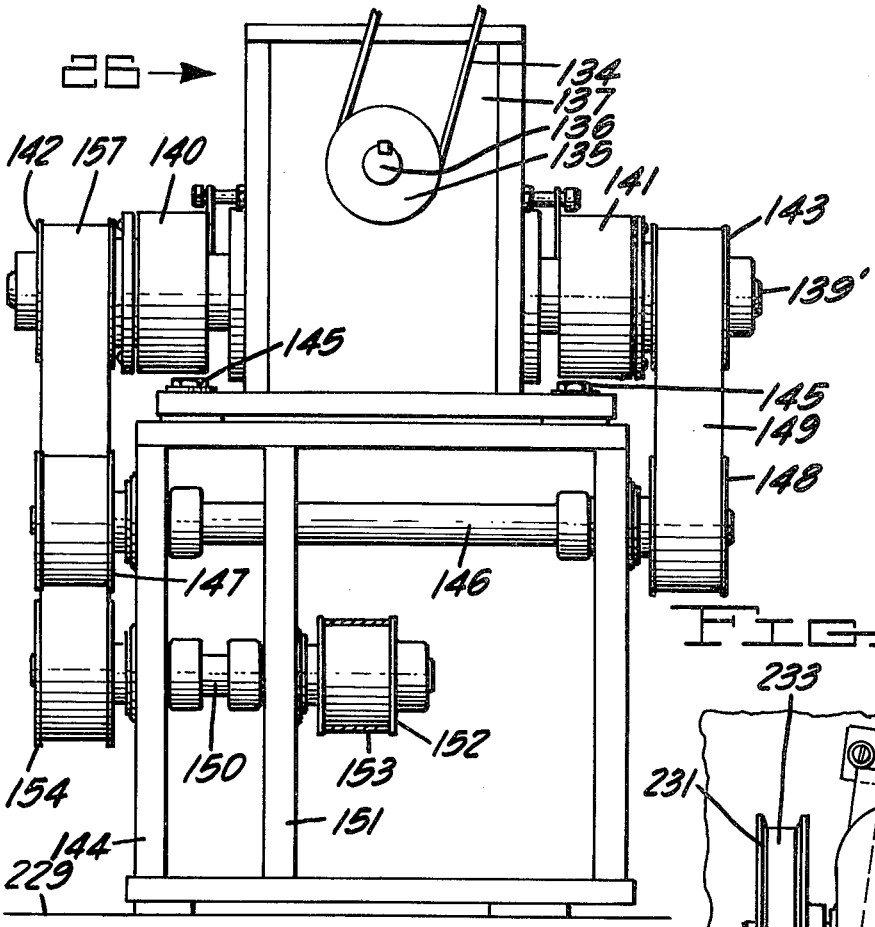
FIG. 25 is a view in side elevation as seen looking in the direction of the indicating arrows of line 25—25 in FIG. 22.

Referring now to FIG. 25, those portions of shaft 139' which extend from each side of gear box 137 carry the means for effecting rotation of said shaft first in one direction and then the other and includes a pair of electro magnetic clutches 140 and 141. A clutch sprocket 142 is assembled on and adjacent one end of shaft 139' in operative association with clutch 140 and a clutch sprocket 143 is assembled adjacent the opposite end of said shaft in operative association with clutch 141.

The gear box 137 is mounted on a support stand 144 by means of cap screws 145. This support stand has an idler shaft 146 rotatably supported therein and with the ends thereof extending outwardly beyond the sides of said stand which carry timing pulleys 147 and 148 disposed below and in alignment with clutch sprockets 142 and 143 respectively.

A timing belt 149 interconnects the clutch sprocket 143 with the timing pulley 148 which is caused to be rotated in a manner now to be described. As shown in FIG. 25 the support stand also has a driven shaft 150 rotatably mounted therein which is journaled adjacent one end in the side of said stand and adjacent the opposite end in a vertically disposed bar member 151 fixedly located within the stand. The end of the driven shaft 150 located within the support stand 144 has a timing pulley 152 fixed thereon and by means of a timing belt 153 said pulley is connected to a source rotary power the speed of which is selectively controllable and which will be further described hereinafter. The opposite end of the driven shaft 150 extends outwardly beyond the side of the support stand 144 and has a timing pulley 154 fixed thereon that is in alignment with pulley 147. This side of the support stand 144 also includes an idler timing pulley 155 (FIG. 22) rotatably mounted on a stud 156 which is disposed in spaced relation to and in alignment with pulleys 147, 154 and the clutch sprocket 142. As shown in FIG. 22 a timing belt 157 of the dual faced type interconnects the timing pulley 154, which is rotatably driven by the timing pulley 152, with the idler timing pulley 155, the clutch sprocket 142 and the timing pulley 147. This timing belt 157 is assembled so that its inner driving face engages pulleys 154, 155 and the clutch sprocket 142 and its outer driving face engages pulley 147. This arrangement of the timing belt 157 causes the clutch sprocket 142 and clutch 140 operatively associated therewith to rotate in one direction and the timing pulley 147 to rotate in the opposite direction. The direction of rotation of timing pulley 147 is transmitted through the idler shaft 146 to the timing pulley 148 and thence by means of the timing belt 149 to the clutch sprocket 143 and the clutch 141 operatively associated therewith.

The electro-magnetic clutches 140 and 141 are alternately energized by a switching means now to be described which causes shaft 139' to be rotatably driven first in one direction and then the other. This alternate rotary movement is transmitted through the gear box 137 to the drive belt 134 by means of drive pulley 135 and by means of the driven pulley 133 the alternate rotary movement is transmitted through the driven shaft 132' to the pulley 131' to effect reciprocal movement of the timing belt 130.

Figure 19:
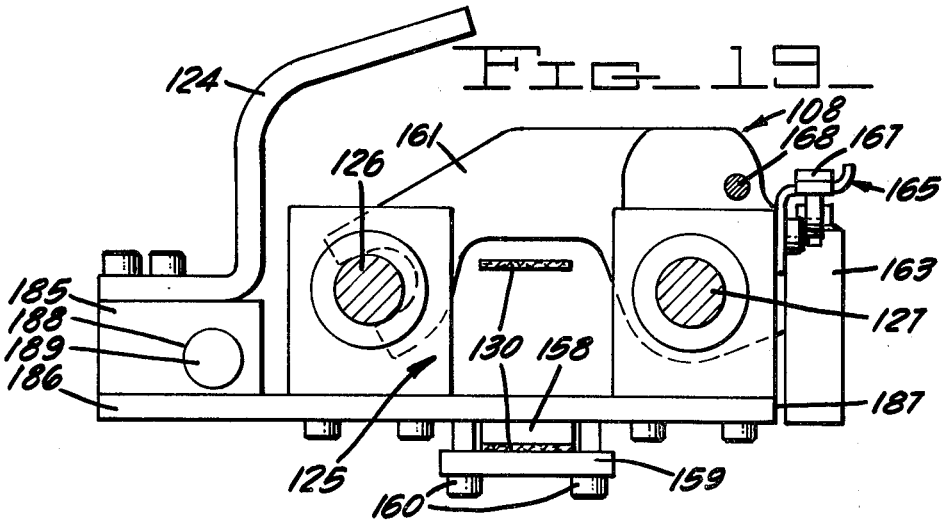
FIG. 19 is a sectional view as seen looking in the direction of the indicating arrows of line 19—19 in FIG. 18 and turned 90 degrees.

As shown in FIG. 19, the timing belt 130 is attached to the underside of the carriage 125 by extending between a pair of plate members 158 and 159 which are clamped to said carriage by means of cap screws 160. The carriage having the timing belt 130 clamped to it in the manner described is caused to reciprocate with said belt by sliding to and fro on the traverse rods 126 and 127. To control the limit of movement of the carriage 125 the traverse rods have a pair of switch supports 161 and 162 mounted thereon (FIG. 18) which are located adjacent to stand members 128 and 129 respectively.

A micro-switch 163 is mounted on support 161 and a micro-switch 164 is mounted on support 162. Referring again to FIG. 18, a trip element generally indicated by numeral 165 is attached to the carriage 125 and is disposed so as to extend in the direction of movement of said carriage. The opposite ends of the trip element 165 define fingers 166 and 167 and are disposed so that finger 166 will engage micro-switch 163 and finger 167 micro-switch 164 during the reciprocating movement of the carriage. The micro-switches 163 and 164 are in circuit with the electro-magnetic clutches 141 and 140 respectively which are effective in reversing the direction of movement of the carriage each time one of the fingers 166 or 167 engages its respective micro-switch.

Figure 20:
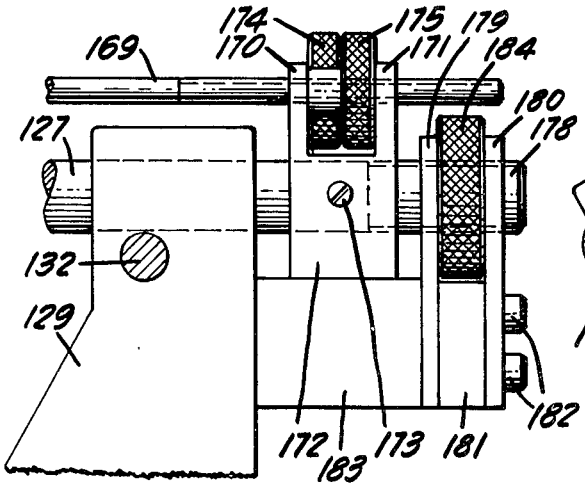
FIG. 20 is a view of that portion of FIG. 18 as seen looking in the direction of the indicating arrow 20.
Figure 21:
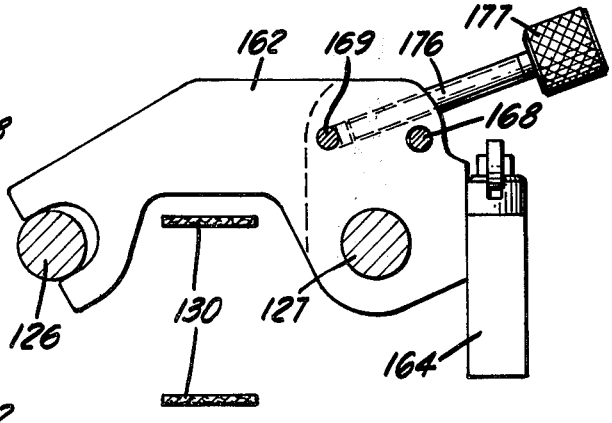
FIG. 21 is a view in side elevation and partially in section taken along line 21—21 in FIG. 18 and turned 90 degrees.

A means is provided for selectively controlling the distance the carriage 125 is caused to travel on the traverse rods 126 and 127 and is accomplished by shortening or increasing the distance between the micro-switches 163 and 164. The switch supports 161 and 162 are adjustably slidable on the traverse rods by means of threaded rods 168 and 169 respectively. These rods extend parallel with the axes of the traverse rods and are operatively connected to their respective switch supports and by turning said rods in one direction or the other said supports can be selectively moved toward or away from one another. The rods extend through aligned openings provided in a pair of spaced, upwardly directed and integrally formed ear elements 170 and 171 of a support block 172 that is assembled on and adjacent one end of the traverse rod 127 by means of a set screw 173 (FIG. 20). Those portions of the rods 168 and 169 which extend between the ear elements 170 and 171 each have an adjusting knob assembled thereon with numeral 174 identifying the knob on rod 168 and numeral 175 the knob on rod 169. The threaded portion of rod 168 extends through a threaded hole in the switch support 161 so that rotation of knob 174 causes said support to move along the length of said threaded portion.

The threaded portion of rod 169 extends through a threaded hole in the knob 175 and switch support 162 is fixedly located on said rod so that rotation of said knob causes longitudinal movement of the rod and sliding movement of the support on the traverse rods 126 and 127.

The switch support 162 is fixed on the rod 169 by means of an elongated threaded rod 176 having a lock knob 177 formed on the outer end thereof which together serve as a set screw and which can be loosened to permit manual adjustment of the switch support 162.

As shown in FIG. 20, that end of the traverse rod 127 which extends through and beyond the outerside of stand member 129 is threaded as at 178. This threaded end 178 extends through aligned openings provided in a pair of upwardly directed plate members 179 and 180 which are spaced one from the other by a block 181 disposed in contiguous relation with the lower opposed surfaces of said plate members. The combination of plate members 179, 180 and block 181 are attached by means of cap screws 182 to a block element 183 which by means not shown is suitably attached to the outer surface of the stand member 129.

The threaded portion of the traverse rod 127 which extends between plate members 179 and 180 has an adjusting knob 184 assembled thereon which provides a means for limited longitudinal adjustment of the traverse rod 127. Movement of this traverse rod in one direction or the other by manually rotating knob 184 causes simultaneous like movement of the switch supports 161 and 162. Movement of the switch supports 161 and 162 in this manner provides a means for aligning the pathway of the carriage with the barrel of the bobbin 101 to which the band of ends 42 are fed and wrapped by devices yet to be described. It is common knowledge that the head thickness of a bobbin can vary from one bobbin to another and for this reason it is necessary that a means be provided to align the pathway of the carriage with the barrel of the bobbin when replacing a wound bobbin with a fresh one.

The pair of bracket members 124 on which the rollers 122 and 123 are mounted are attached at their lower ends to a pair of spaced support blocks 185. These support blocks 185 are fixed by any suitable means, not shown, to integrally formed fingers 186 which extend from a plate element 187 that forms the lower supporting member of the carriage 125. Each of the support blocks 185 is provided with an opening 188 (one only shown in FIG. 19) that are in alignment one with the other and which serve to fixedly support the ends of a rod 189 therein.

Figure 7:
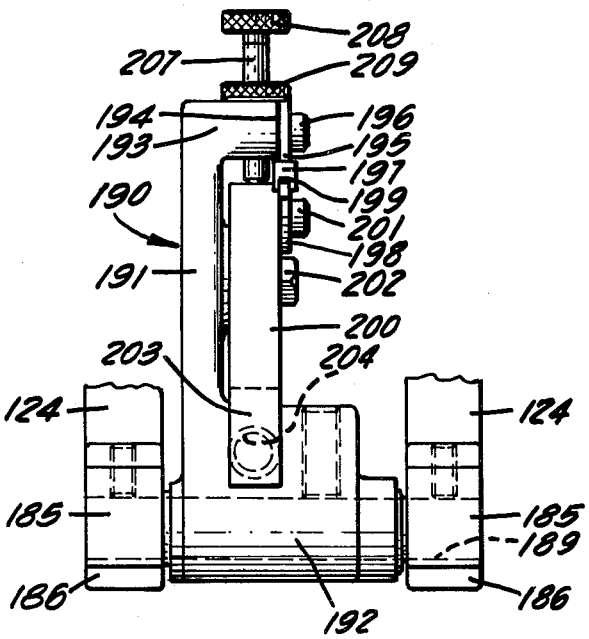
FIG. 7 is a view as seen looking in the direction of the indicating arrow 7 in FIG. 6.

A device for presenting the band of ends 42 to the bobbin 101 is pivotably mounted on the rod 189 intermediate the support blocks 185 (FIG. 7) and is identified generally by numeral 190. This device 190 includes a beak support arm 191 having a lower hub portion 192 which serves to pivotably support said arm on the rod 189. The upper end of the support arm 191 includes an integrally formed and laterally extending lip 193 that terminates in a flat, vertically extending surface 194 (FIG. 7) having an upper beak member 195 fixed thereon by means of screws 196. This upper beak member 195 is of elongated configuration and the free end thereof is provided with an integrally formed and inverted U-shaped member 197. Member 197 cooperates with the free end of a lower beak 198 to form a rectangular channel 199 through which the band of ends 42 pass for presentation to the bobbin for the building of a band package thereon.

The lower beak 198 is attached to a support lever 200 by means of screws 201 and said support lever is pivotably attached to the support arm 191 intermediate its ends by a cap screw 202. The support lever 200 is located below and in alignment with the lip 193 which positions the lower beak 198 carried thereby in alignment with the upper beak member 195. The lower end of the support lever 200 is of reduced thickness and defines a finger 203 (FIG. 6) disposed in spaced relation to the lower portion of the support arm 191. One end of a coil spring 204 is seated within a pocket 205 provided in the lower portion of the support arm 191 and the opposite end is in biasing contact with the finger 203 of the support lever 200 and serves as a means for continually urging the latter in a clockwise direction as viewed in FIG. 6. This biasing force of coil spring 204 maintains the upper surface of the support lever 200 in contact with the lower end of a set screw 206 assembled in a tapped hole provided in the lip 193. Set screw 206 serves as a means for adusting the height of the rectangular opening 199, for by its particular setting the distance the free end of the lower beak 198 is caused to enter between the legs of the U-shaped member 197 can be selectively controlled.

To facilitate the insertion of a band of ends within the rectangular channel 199 the lip 193 also has a jack screw 207 assembled therein (FIGS. 6 and 7) with the lower end disposed in engagement with the upper surface of the support bar 200. The upper end of this jack screw terminates in a knurled control knob 208 and includes a knurled lock nut 209 assembled on the threaded portion thereof which is adapted to engage the upper surface of the lip 193. By simply loosening the lock nut 209 the jack screw 207 can be manually rotated in a direction to effect pivotal movement of the support lever 200 in a counter-clockwise direction as viewed in FIG. 6 and against the biasing force of the coil spring 204. Pivotal movement of the support lever 200 in this manner pivots the free end of the lower beak 198 downwardly and clear of the U-shaped member 197. Rotation of the jack screw 207 in the opposite direction permits the biasing force of coil spring 204 to pivot the support lever 200 back to its initial position in contact with the set screw 206.

Figure 6:
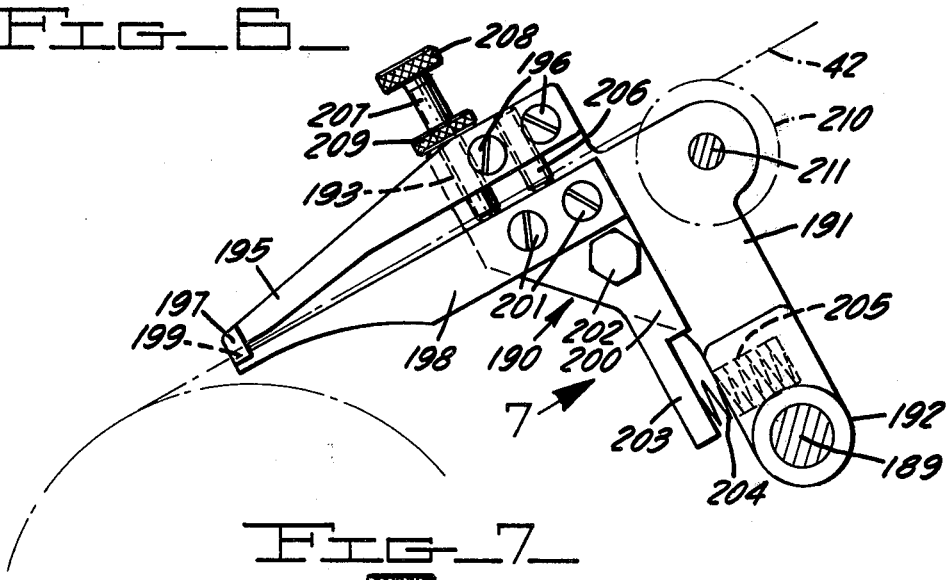
FIG. 6 is a view on an enlarged scale of the left side of FIG. 4 showing the beak member for feeding the band to a bobbin.

In alignment with the path of travel of the band of ends 42 between the upper and lower beaks 195 and 198 respectively, the support lever 200 rotatably supports a flanged roller 210 by means of a stud 211 (FIG. 6). This roller as shown in FIGS. 1 and 5 has an operating position located intermediate the rollers 122 and 123 and the band entrance end of the upper and lower beaks 195 and 198. The band as it exits from between rollers 122 and 123 is traveling in the same pathway to which it was oriented by rollers 109 and 110 after leaving the metering wheel 96.

The flanged roller 210 is disposed so as to be engaged by the band as the latter exits from between rollers 122 and 123 and is effective in turning the band so that it will enter between the upper and lower beaks in that plane of travel it was caused to follow prior to being turned by rollers 109 and 110.

Figure 3:
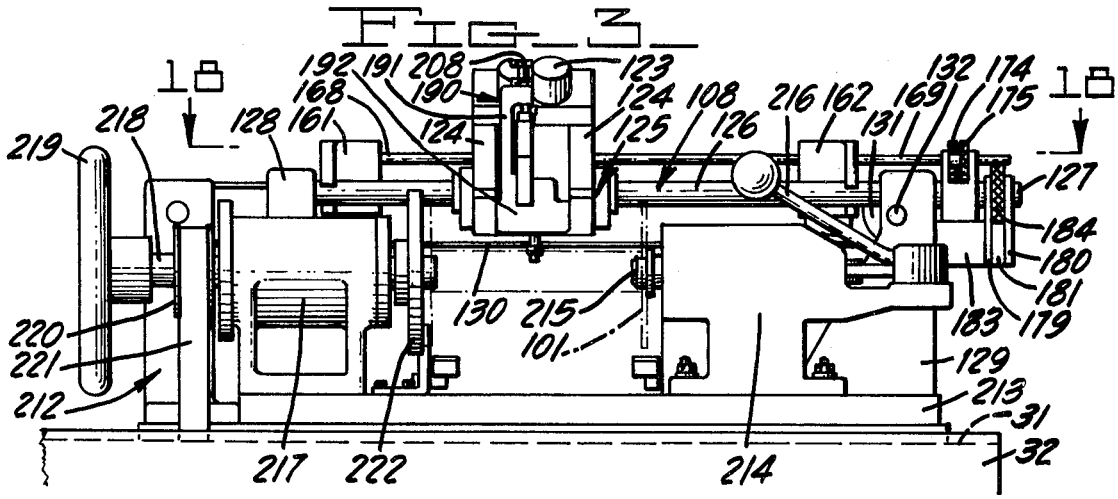
FIG. 3 is a view on an enlarged scale of the upper portion of FIG. 2.

The apparatus for rotating the bobbin 101 to build a band package thereon is identified generally in FIGS. 2, 3 and 4 by numeral 212 and includes a bed plate 213 for mounting said apparatus on the top planar surface 31 in relatively close proximity with the traversing mechanism 108. This apparatus includes among its various parts a tail stock assembly 214 having a flanged rod 215 supported therein which is longitudinally movable by means of a lever 216. In alignment with and spaced from the tail stock assembly the apparatus further includes a head stock assembly 217 having a shaft 218 rotatably mounted therein. Shaft 218 extends outwardly from each end of the head stock assembly 217 and the outer end has a hand wheel 219 fixed thereon. A timing pulley 220 is also fixed on the shaft 218 intermediate the hand wheel 219 and the head stock assembly 217. A timing belt 221 interconnects the timing pulley 220 with a source of rotary movement, yet to be described, which provides a means for rotatably driving the shaft 218. That end of shaft 218 opposite that which carries the hand wheel 219 has a driving disc 222 fixed thereon which in cooperation with the flanged rod 215 supports and rotates a bobbin 101 during the building of a band package thereon.

As shown in FIG. 24 the timing belt 221 is driven from a timing pulley 223 that is mounted on a jack shaft 224. This jack shaft 224 is journaled in a pair of spaced pillow blocks 225 and 226 which in turn are attached to mounting blocks 227 and 228 respectively that are fixed by any suitable means to the lower interior surface 229 of the supporting frame.

Figure 27:
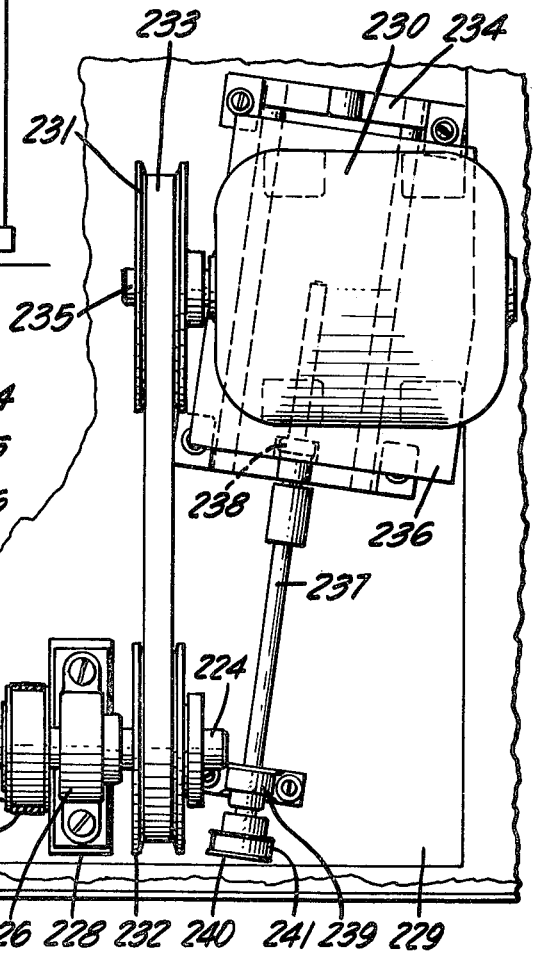
FIG. 27 is a plan view of the source of drive for the machine as seen looking in the direction of the indicating arrow 27 in FIG. 24.

The jack shaft 224 is rotatably driven by an electric motor 230 having a variable pitch sheave 231 (FIG. 27) that is operatively connected to a sheave 232 assembled on said jack shaft by means of a drive belt 233.

To vary the pitch of sheave 231 the electric motor 230 is selectively movable toward and away from the jack shaft 224 by being adjustably mounted on a support stand 234 that extends at an angle oblique to the axis of the motor shaft identified by numeral 235. The base of the motor is identified by numeral 236 (FIGS. 24 and 27) and by means of a threaded rod 237 operatively associated therewith, as at 238, the motor 230 can be selectively located on the support stand 234 to increase or decrease the pitch of sheave 231 by simply turning rod 237 in one direction or the other.

A pillow block 239 supports the rod 237 adjacent that end most remote from the motor's base 236. This end of the rod 237 extends through the pillow block 239 and has a motor adjustment pulley 240 fixed thereon.

Referring now to FIG. 24 pulley 240 is rotated in one direction or the other by means of a belt 241 which is operatively connected to a pulley 242 fixed on one end of a horizontally disposed shaft 243 that is selectively rotatable by means of a hand wheel 244. Shaft 243 is rotatably supported in the depending legs of an inverted U-shaped support bracket 245 which attaches by any suitable means to the upper interior surface 246 of the supporting frame. The front vertical panel 32 of the supporting frame includes an opening 247 through which a portion of the hand wheel 244 protrudes and by manually turning said hand wheel in one direction or the other the speed of the motor 230 can be varied as desired through a change in pitch of the sheave 231.

In FIGS. 23 and 24 a flywheel 248 is shown assembled on the jackshaft 224 intermediate the timing pulley 223 and the pillow block 225 and serves as a means for obtaining the necessary coast time for the driving elements when stopping the machine.

Referring now to FIGS. 22 and 23, that end of the jack shaft 224 most remote from the motor 230 extends through and beyond the pillow block 225, and has a timing pulley 249 assembled thereon. This timing pulley 249 is operatively connected to an infinite variable power transmission unit generally indicated by numeral 250 by means of a timing belt 251 which is in driving engagement with a power input pulley 252 that is mounted on a shaft 253 extending outwardly from one side of said transmission unit. Below the pulley 252 and in alignment therewith the transmission unit 250 includes a power output pulley 254 assembled on a shaft 255 which like shaft 253 extends outwardly from the side of said transmission unit (FIG. 22). This power output pulley 254 is in driving engagement with the timing belt 153 and as heretofore described provides the means for effecting rotation of the various pulleys mounted on the support stand 144 and the electro-magnetic clutches 140 and 141 for actuation of the traversing mechanism 108.

To vary the speed of the power output pulley 254, the transmission unit 250 is selectively adjustable by means of a hand wheel 256 which is disposed adjacent to hand wheel 244 and which is adapted to protrude through an opening 257 provided in the front vertical panel 32 of the supporting frame. This hand wheel 256 is assembled on a horizontally disposed shaft 258 which is rotatably supported in the depending legs of an inverted U-shaped bracket 259 that attaches by any suitable means to the aforementioned surface 246.

Shaft 258 also has a sprocket member 260 fixed thereon which is disposed in contiguous relation with the hand wheel 256. A sprocket chain 261 interconnects sprocket member 260 with a sprocket 262 fixed on one end of a shaft 263 that is rotatably supported by the legs of a U-shaped bracket 264. The bracket 264 is attached by any suitable means to a pair of depending support members 265 which in turn are suitably fixed to surface 246. The opposite end of shaft 263 also has a sprocket member 266 fixed thereon and by means of a sprocket chain 267 it is operatively connected to a sprocket 268. This sprocket 268 is assembled on a shaft 269 (FIG. 23) which extends outwardly from the side of the transmission unit as at 270 in FIG. 23. Shaft 269 is operatively associated with the elements (not shown) contained within the transmission unit and depending on the direction of selective manual rotation of the hand wheel 256 it is effective in increasing or decreasing the rotational speed of the power output pulley 254.

Figure 11:
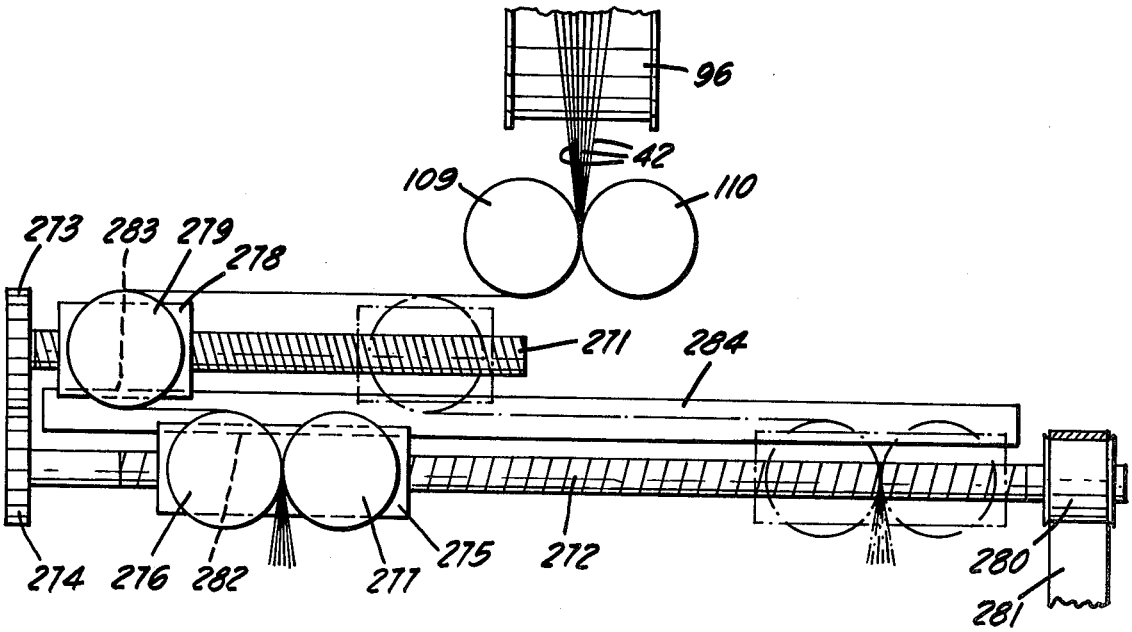
FIG. 11 is a view similar to FIG. 10 but showing a modification of the pathway for a band.
Figure 12:
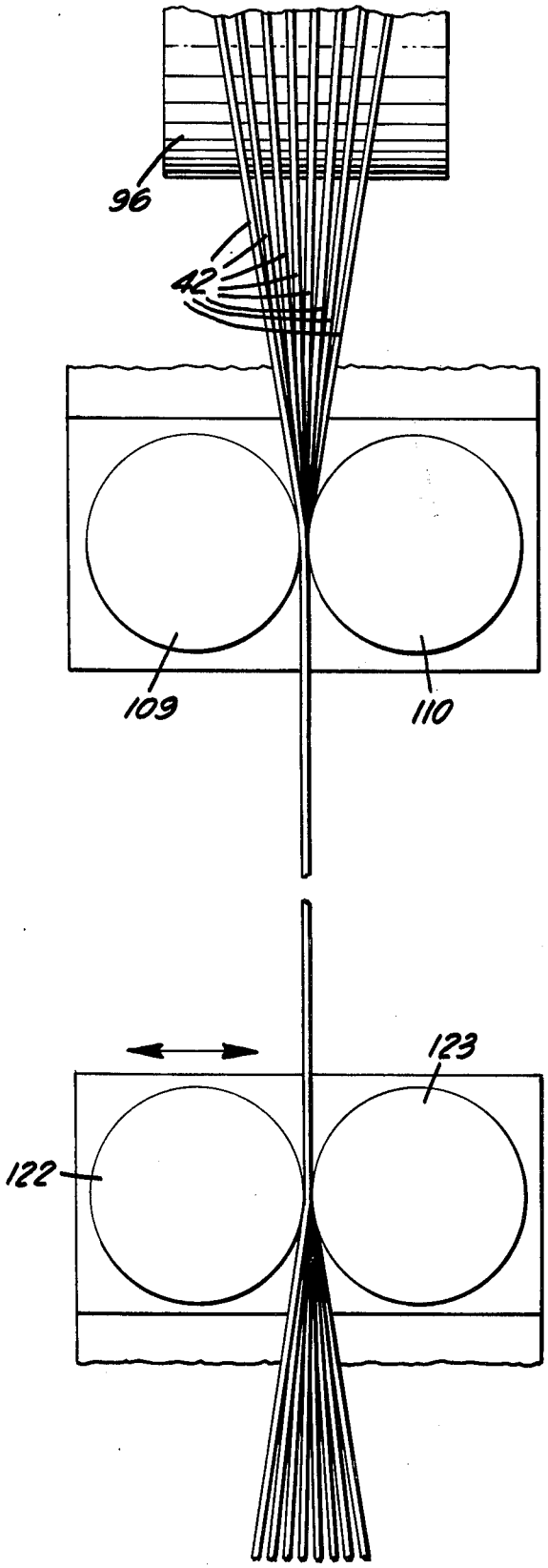
FIG. 12 is a top view schematically illustrated showing the positioning device for changing the attitude of the band.
Figure 13:
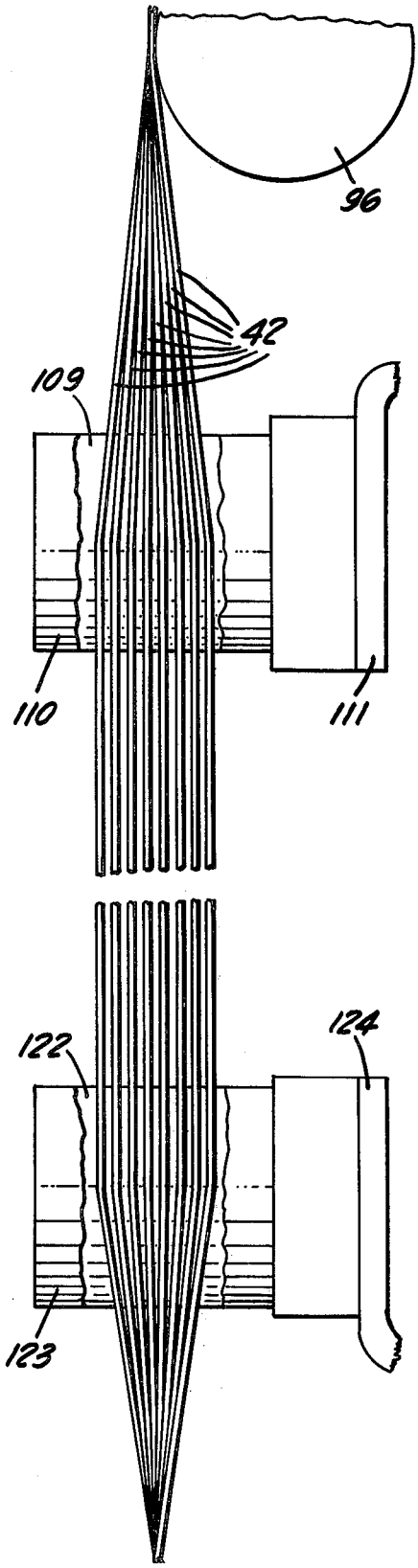
FIG. 13 is a side view of the device shown in FIG. 12.

FIG. 11 shows a modification of the pathway the band is caused to follow after it passes between rollers 109 and 110 that effect the turning of said band so that it will continue its travel in a plane turned 90° from the plane it was traveling prior to passing between said rollers. This modification is provided with a pair of spaced lead screws 271 and 272 which are disposed in parallel relation with said lead screw 271 having a gear member 273 fixed on one end thereof which is in meshing relation with a gear member 274 fixed on the adjacent end of said lead screw 272. An internally threaded support block 275 is assembled on the threaded portion of lead screw 272 and rotatably supports a pair of juxtaposed rollers 276 and 277 on the upper surface thereof which are adapted to perform the same function as rollers 122 and 123 heretofore described.

An internally threaded support block 278 assembles on the threaded portion of the lead screw 271 and rotatably supports a guide roller 279 on the upper surface thereof. The lead screw 272 has a timing pulley 280 assembled on that end opposite the end which carries the gear member 274 and by means of a timing belt 281 it is operatively connected to any suitable source of rotatable driving means not shown. The driving means for effecting rotation of the lead screw 272 is operatively connected to the elctro-magnetic clutches 140 and 141 which cause said lead screw to be rotated first in one direction and then the other. Lead screw 272 is provided with a right hand thread and by alternately reversing its direction of rotation, the support block 275 and rollers 276 and 277 carried thereby are caused to travel between the solid and phantom line positions shown in FIG. 11.

Lead screw 271 is provided with a left hand thread which has one half the pitch of the thread of lead screw 272 and with said screws being interconnected by gear members 273 and 274 said lead screw 271 is also caused to alternately reverse its direction of rotation. The alternate reversal of rotative movement of lead screw 271 causes the support block 278 and roller 279 mounted thereon to move simultaneously with and in the same direction as support block 275 between the solid and phantom line positions shown in FIG. 11. The opposed sides of the support blocks 275 and 278 are provided with guide channels 282 and 283 respectively which engage a guide bar 284 disposed intermediate the lead screws 271 and 272 which serves to stabilize said support blocks during their travel to and fro. The band of ends after passing between rollers 109 and 110 is directed so as to engage the outer surface of the guide roller 279 and is thence directed so as to pass between rollers 276 and 277. As with the construction of the preferred embodiment the band of ends after passing between rollers 276 and 277 passes through the device identified generally by numeral 190 (FIGS. 6 and 7) which presents said band to the rotatably driven bobbin 101 for the building of a band package thereon.

The guide roller 279 being disposed intermediate the pairs of rollers 109, 110 and 276, 277 and being caused to move simultaneously in a plane parallel with and one-half the overall distance of the latter pair of rollers provides a linear festooning pathway for the band. With this form of pathway the band never changes its direction of travel and the total amount of the ends forming the band within the limits of said pathway remains constant regardless of the position of the movable rollers.

To summarize the operation the individual ends are withdrawn from their respective supply spools 41 by the pulling force of the band being wrapped on the rotatably driven bobbin 101. The tension under which the ends are withdrawn is controlled by the amount of braking force the brake puck 44 exerts against the underside of the brake disc 43. The linkage between the dancer lever 53 is such that an increase in tension of an end 42 will cause said lever to pivot in a counter-clockwise direction as viewed in FIG. 14. This movement pulls the brake rod 67 in a direction that causes the brake release spring 72 to act on the brake lever 49 in a manner to decrease the braking force with which the brake puck 44 engages the brake disc 43. In the event of a decrease in the desired amount of tension on a particular end 42, the dancer lever will pivot in a clockwise direction by the retracting force of coil spring 61 as also viewed in FIG. 14. This movement permits coil spring 74 to seek its free length and in so doing pivots the brake lever 49 in a direction so as to increase the braking force of the brake puck 44 on the brake disc 43.

From the upper sheaves 59 on the dancer levers the individual ends are directed to guide sheaves 87 and thence to the metering wheel 96 which receives all of the ends simultaneously and is effective in joining them as a band of contiguous ends of equal length. From the metering wheel the band passes between a pair of rollers 109 and 110 which are effective in turning the band so that it will travel in a plane turned 90° from the plane of travel at which it left said metering wheel. The band is maintained in this path of travel until it passes through a pair of rollers 122 and 123 which are the same as rollers 109 and 110 but are spaced from the latter and are supported on the carriage 125 of the traversing mechanism 108. That portion of the band passing between rollers 122 and 123 is caused to reciprocate to and fro with the traversing mechanism and due to the pathway of the band extending parallel with the axes of said rollers the individual ends are maintained at equal length and the change in distance between the two pairs of rollers (109, 110 and 122, 123) is reflected identically in all of the ends comprising said band.

After passing between rollers 122 and 123 the band passes through the device 190 carried by the traversing mechanism which is effective in first returning said band to its initial plane of travel and then guiding said band as it is reciprocated to and fro by the traversing mechanism to the rotatably driven bobbin 101 for the building of a band package thereon.

Although the present invention has been described in connection with a preferred embodiment and a single modification thereof, it is to be understood that further modifications and variations may be resorted to without departing from the spirit and scope of the invention as those skilled in the art will readily understand. Such modifications and variations are considered to be within the purview and scope of the invention and the appended claims.

We claim:

1. In a strand winding apparatus wherein a plurality of ends of strand material are drawn from individual supply spools, assembled into a flat band comprised of strand ends of equal length and wound through a traversing mechanism onto a collecting bobbin, the improvement comprising:

(a) first means to receive said assembled flat band and rotate said band 90° from its original assembled position, and (b) second means associated with the traversing mechanism and traveling therewith to receive the rotated band and to rotate it to substantially the same relative angular position which it had upon initial assembly, whereby the flat band can be wound onto the collecting bobbin.

2. The strand winding apparatus according to claim 1 wherein said first means defines a first pair of juxtaposed rollers the axes of which extend perpendicular to the bands original assembled position.

3. The strand winding apparatus according to claim 2 wherein said pair of juxtaposed rollers provides a line of pivot for the band that is common to each of the ends thereof during reciprocable movement of said second means by the traversing mechanism.

4. The strand winding apparatus according to claim 2 wherein said second means includes a second pair of juxtaposed rollers the axes of which extend in the same direction as the axes of the rollers of said first means.

5. The strand winding apparatus according to claim 4 wherein said second means includes:

(i) a flanged roller for receiving the band from said second pair of juxtaposed rollers and returning the same to its original assembled position; and (ii) a pivotably mounted beak member with means defining an internal channel for receiving the band from said flanged roller and guiding the band to the collecting bobbin.

6. The strand winding apparatus according to claim 4 wherein said second means includes a guide roller for engaging the band intermediate said first and second pairs of juxtaposed rollers with gear means for effecting simultaneous movement thereof in a plane parallel with and one-half the distance of said second pair of juxtaposed rollers.

7. A method of winding a plurality of ends of strand material drawn from independent single-end supply spools, as a contiguous band of separate ends onto a rotatably driven bobbin while maintaining equal length of each end forming the band, said method including the steps of:

(a) withdrawing each end simultaneously from their respective supply spools;

(b) maintaining a pre-selected amount of tension on each of said ends during their withdrawal;

(c) guiding the ends through a predetermined path of travel;

(d) wrapping each of said ends simultaneously about the periphery of a metering wheel to form a band of contiguous ends of equal length;

(e) rotating the band to travel in a plane normal to that at which it left the metering wheel;

(f) moving the band to and fro along the length of the bobbin while traveling in the rotated path of travel;

(g) rotating the band to its initial path of travel; and (h) feeding the band while moving to and fro to a rotatably driven bobbin for the building of a band package thereon.

* * * * *